United States Patent [19]

de Wijn

[11] 4,205,755

[45] Jun. 3, 1980

[54] TAMPER-PROOF BOTTLE CLOSURE

[75] Inventor: Jacques A. de Wijn, Hoevelaken, Netherlands

[73] Assignee: Lindner Industrie B.V., Netherlands

[21] Appl. No.: 911,287

[22] Filed: May 31, 1978

[30] Foreign Application Priority Data

Jun. 10, 1977 [NL] Netherlands ..... 7706402

[51] Int. Cl.[2] ..... B65D 41/34

[52] U.S. Cl. ..... 215/252

[58] Field of Search ..... 215/252, 253, 256

[56] References Cited

FOREIGN PATENT DOCUMENTS

| | | | |
|---|---|---|---|
| 63488 | 6/1975 | Australia | 215/252 |
| 1279091 | 11/1961 | France | 215/252 |
| 1021712 | 3/1966 | United Kingdom | 215/252 |

*Primary Examiner*—Donald F. Norton

[57] ABSTRACT

A tamper-proof bottle closure is formed of a readily deformable material and is threadedly securable on a bottle. The closure includes a top portion from which a skirt depends and a security band which is detachably connected to the skirt along a circumferential line of spaced slots by bridges of material located between the slots. At least one of the bridges is wider circumferentially than the remaining bridges. At least one transverse score line is formed in the security band extending upwardly and terminating in the region of the line of slots. A weakened line is provided extending across at least one of the wide bridges in alignment with the slots. The security band can thus be completely detached from the skirt without leaving a burred edge on the skirt which is apt to injure the user's hand during repeated use of the closure.

5 Claims, 9 Drawing Figures

TAMPER-PROOF BOTTLE CLOSURE

This invention relates to a tamper-proof closure, in particular a closure cap for a bottle or the like with a threaded neck, said closure cap being formed of thin, readily deformable material and having a top portion and a skirt, said skirt being detachably connected to a rim or security band, the skirt and rim being interconnected by bridges of material spaced about the cap's circumference and which bridges interrupt a circumferential slot, at at least one of said bridges being circumferentially wider than the others, and a scoreline, substantially perpendicular to said slot, being formed adjacent the wider bridges.

The rim portion of the closure cap serves for sealing the bottle so long as its contents have not been touched. The skirt of the closure is provided with screwthreads corresponding to the threading on the bottle neck and serves to permit repeated use of the closure after the seal has been broken.

A closure cap of this kind is described in French Pat. No. 1,279,091. When this prior closure cap is unscrewed, the narrow bridges in the skirt of the cap are successively ruptured with the cap moving in the upward direction, and the security band or rim will begin to pivot about the remainder of the cap but, being connected to the cap via the wide bridge, will remain on the bottle neck. In the last unscrewing phase, the security band, connected to the remainder of the cap with the wide bridge, can be removed from the bottle neck. As, however, during subsequent use of the cap, the band is just an awkward protuberance, it will be torn off by the user by hand. As a result a burr will be formed in the wide bridge at the position where it is torn, which burr is left on the lower edge of the cap and may later give rise to injuries to the user's hand, especially if the cap gets stuck from sugar residues from the beverage contained in the bottle, and hence can be unscrewed only with difficulty.

It is an object of the present invention to provide means preventing the occurrence of the drawback referred to.

According to the present invention, a circumferentially extending score line or tear line, in alignment with the circumferential slots is formed at least across the wide bridge.

If now the security band is torn off the remainder of the cap, this is effected, at the wide bridge, according to the score line or tear line, that is to pay, it is not torn at random, and there will hardly, if at all, be any burring.

The present invention further relates to a method of making a closure cap provided with a score line or tear line across the wide bridge, which line connects with the adjacent circumferential slots.

Starting from a capsule with a smooth skirt, the method according to the present invention comprises a first phase in which the skirt is knurled adjacent to the top of the cap, a reinforcing ridge is formed at some distance from the lower edge, and a score line or tear line is formed in the skirt immediately below said ridge, which line is deepened at least at one place, and a second phase in which a slot, interrupted by narrow bridges, is cut in the score line or tear line provided, which slot is interrupted over a larger width at the deepened score line or tear line to form a circumferentially wider bridge, and a non-continuous score line, perpendicular to the slot, is formed at said interruption in the rim portion.

The means for making the closure according to the invention or for carrying out the method described essentially consist of two complementary segments to be mounted on a holder, and a roller rotatable about its axis and movable along the outer circumference of said segments, one segment comprising a circumferentially extending notching edge interrupted by at least one radially adjustable knife, and the other segment comprising means for forming a circumferential slot interrupted by narrow dams and at least one broad dam, and at least one transversely extending, radially adjustable knife at the point where the broad dam is formed in the slot.

In addition, means are provided for forming, in known manner, a knurling adjacent to the top of the capsule and a reinforcing ridge at some distance from the lower edge.

The invention will be described in more detail with reference to the accompanying drawings. In said drawings, FIG. 1 shows, highly schematically, the details of a machine for making a bottle closure which are of interest to the present invention;

FIG. 2–8 show, on an enlarged scale, cross-sectional views, taken on the lines II—II to VIII—VIII of FIG. 1; and FIG. 9 is an elevational view, broken and partially in cross-section showing the closure.

Referring to the drawings, FIG. 1 shows a tool carrier 1 mounting segments 2 and 3. A roller 4, rotatable about its axis, is provided for movement in the direction of the arrow shown. Drive means and the way in which the tools are mounted in the machine are not shown in the drawings as being effected in known manner.

In the embodiment shown, segment 2 has a notching edge for forming an uninterrupted score line or tear line, and knives 5 and 6 capable of locally deepening said score line or tear line. Measured over the circumference of a capsule, these knives are spaced apart a distance of approximately 180°. Blades 5 and 6 are radially adjustable, as indicated diagrammatically by screw thread.

The second segment 3 has a circumferentially extending cutting edge with interruptions 7 for forming the narrow bridges in the capsule. Furthermore segment 3 has transversely extending knives 8 and 9, which are likewise radially adjustable, which is indicated diagrammatically by screw thread. These knives are arranged to form a transverse score line in the rim portion of the capsule, i.e. perpendicular to the slot interrupted by the bridges. The cutting edge is interrupted so that a circumferentially wide bridge is formed at the position of knives 8 and 9. The angular spacing between knives 8 and 9 is, therefore, also approximately 180°.

FIGS. 2–8 show cross-sectional view of the various capsule processing phases for the manufacture of the desired bottle closure.

The capsule is put on roller 4 with a smooth wall. In the first phase a knurling is formed in the immediate vicinity of the top of the capsule by primary and secondary knurling means 11 and 12, and also a depression 13 by an edge 14.

A rigidifying ledge or ridge 16 is formed at some distance from the lower rim of the capsule by a shoulder 15 on roller 4.

Immediately below ridge 16, a score line or tear line is formed in the capsule, which line is deepened at the position of knife 5, which is clearly shown at 17.

FIG. 3 differs from FIG. 2 to the extent that the score line, which extends throughout the circumference of the capsule, is less deep, which is indicated at 18.

FIG. 4 shows a somewhat more detailed cross-sectional view of the roller and the moulding means.

Segments 2 and 3, as here shown segment 3, are secured to the tool holder by means of bolts 19 or the like. Roller 4 is made of several parts and is rotatable about its longitudinal axis. The position of the primary and secondary knurling means is clearly shown here. 20 is a support plate, against which a capsule is slidingly supported during the deformation and cutting of its skirt.

FIG. 5 illustrates a situation showing that the scoring at the wide bridge is deeper and sharper than in FIG. 2. 21 designates a bevel.

It is clear that the angular distance between knife 6 and knife 8 must be approximately 180°, in order that the transverse score line is made adjacent a wide bridge.

Figure 8:
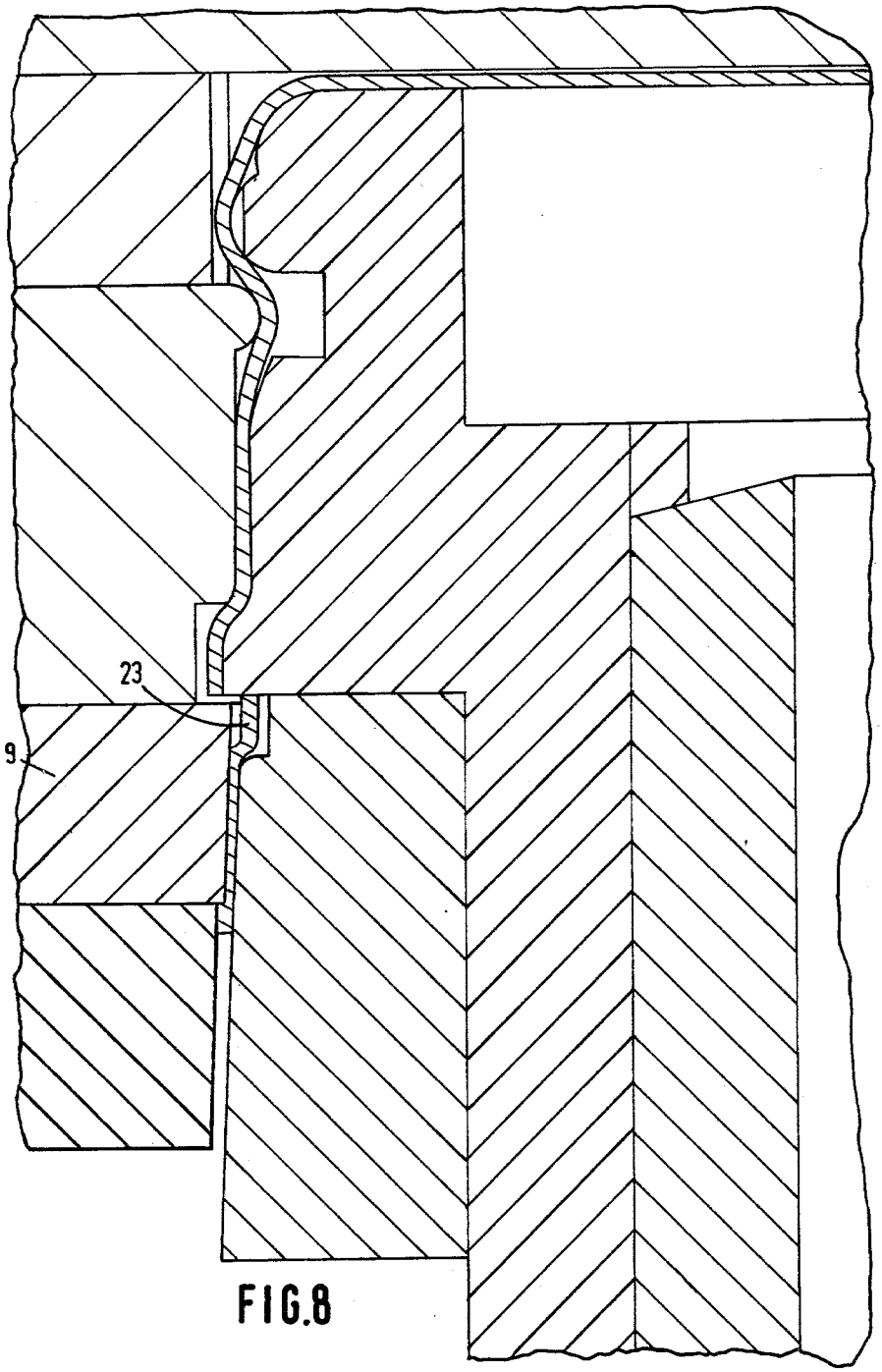

FIG. 8 shows the last part of the processing phase. The capsule has then made almost 1¾ revolutions. Knife 9 has made the transversely extending score line in the lower edge of the capsule.

Figure 1:
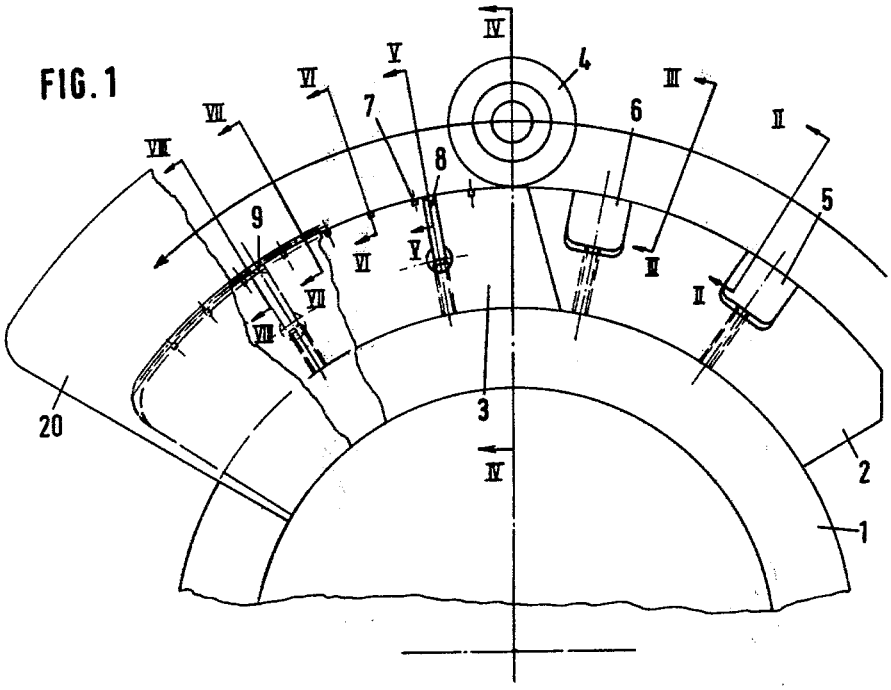
Figure 2:
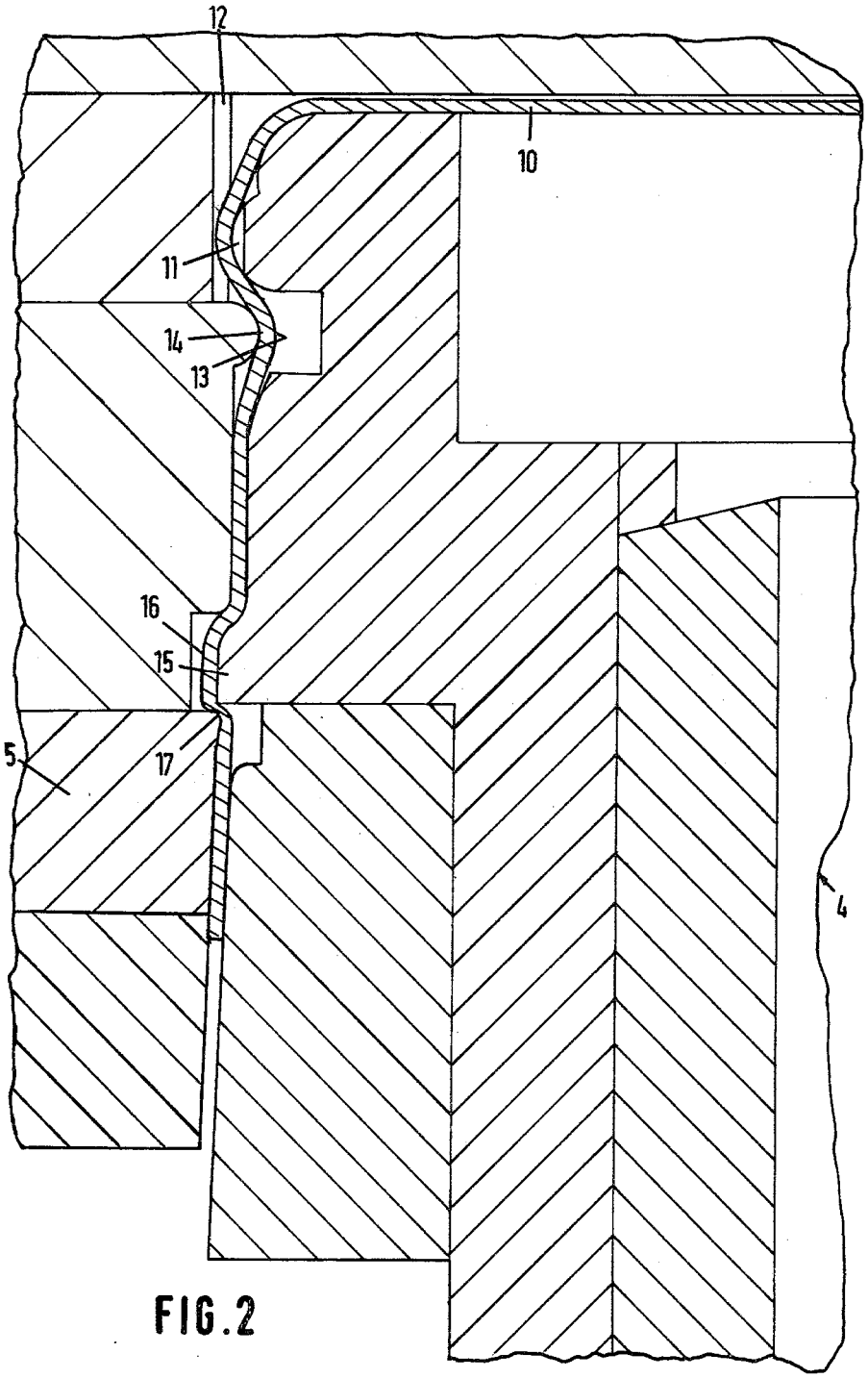
Figure 3:
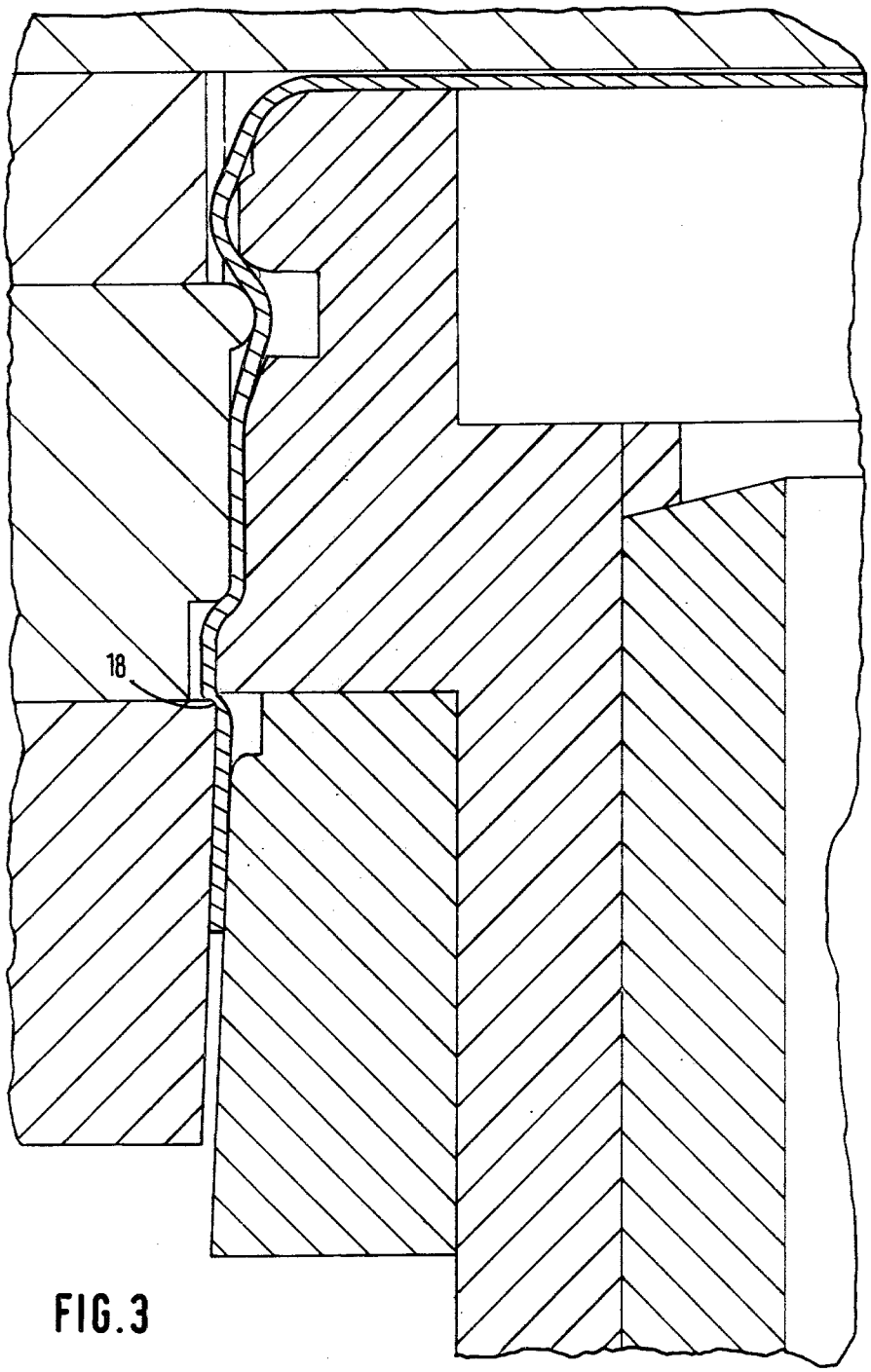
Figure 4:
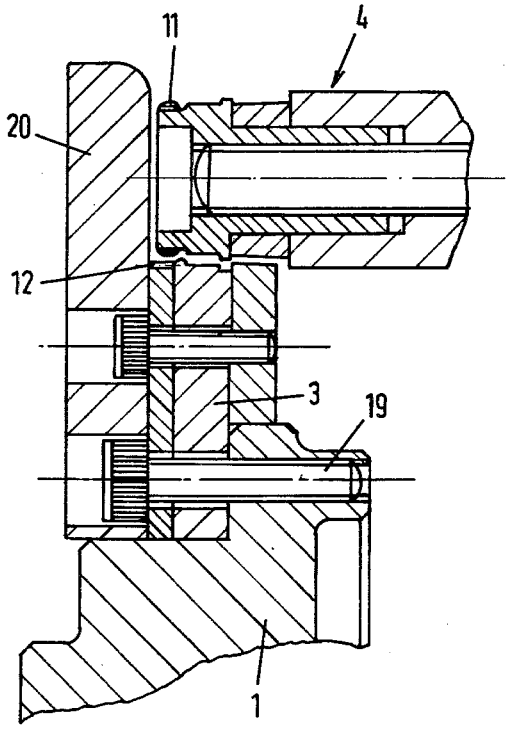
Figure 5:
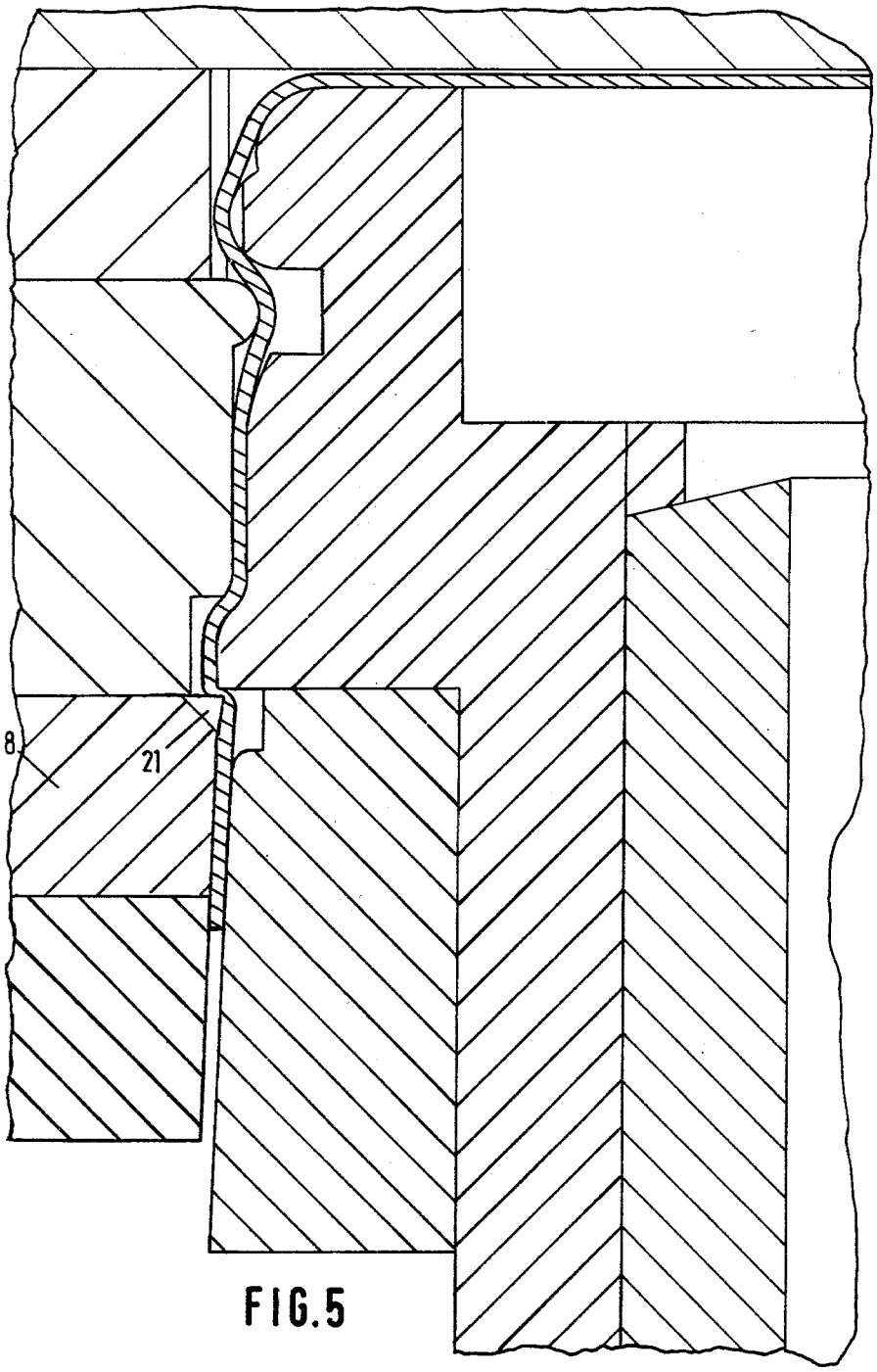
Figure 6:
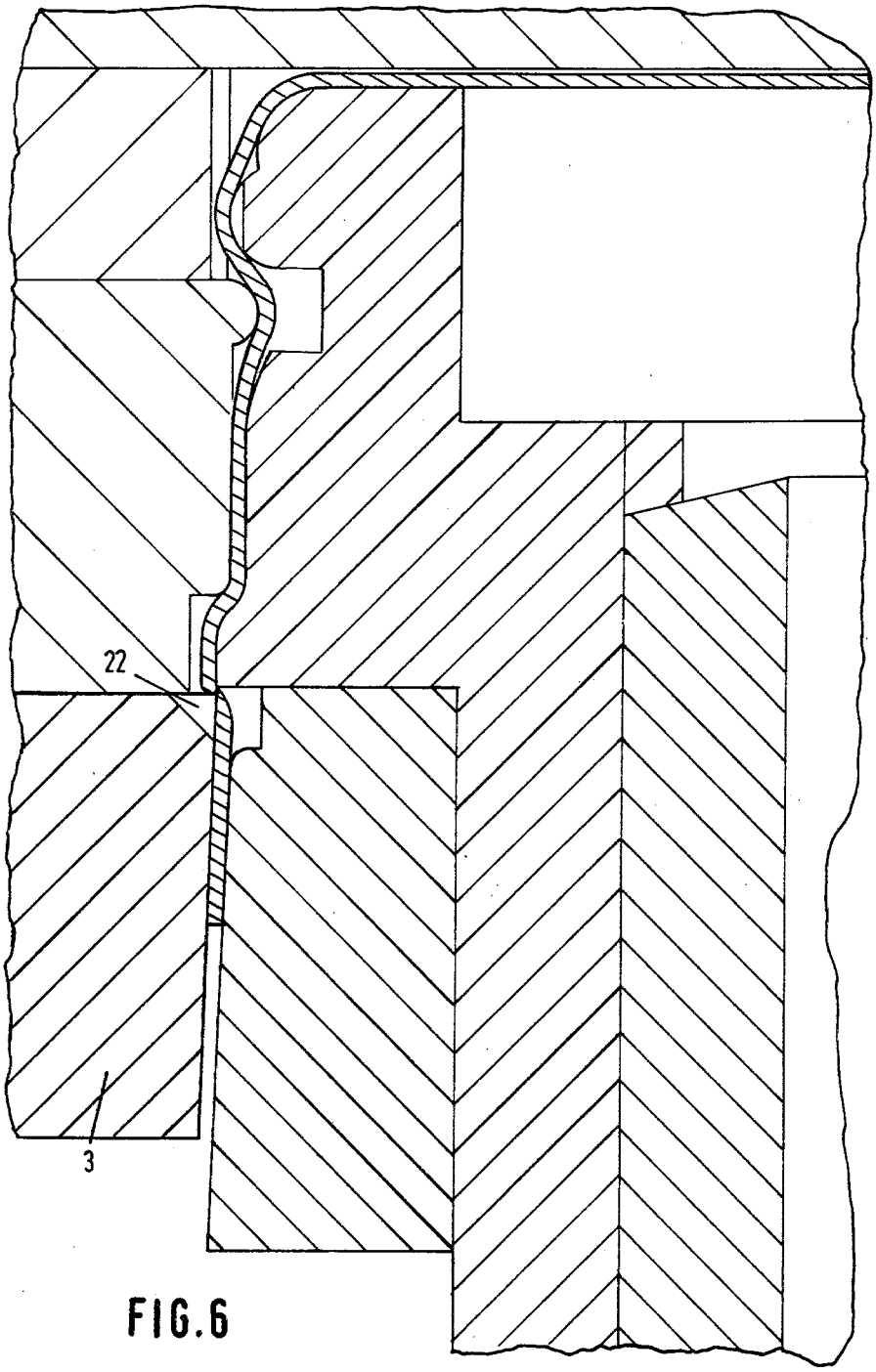
FIG. 6 shows an interruption 22 in the segment at the point where a narrow bridge is to be formed (also see FIG. 3).
Figure 7:
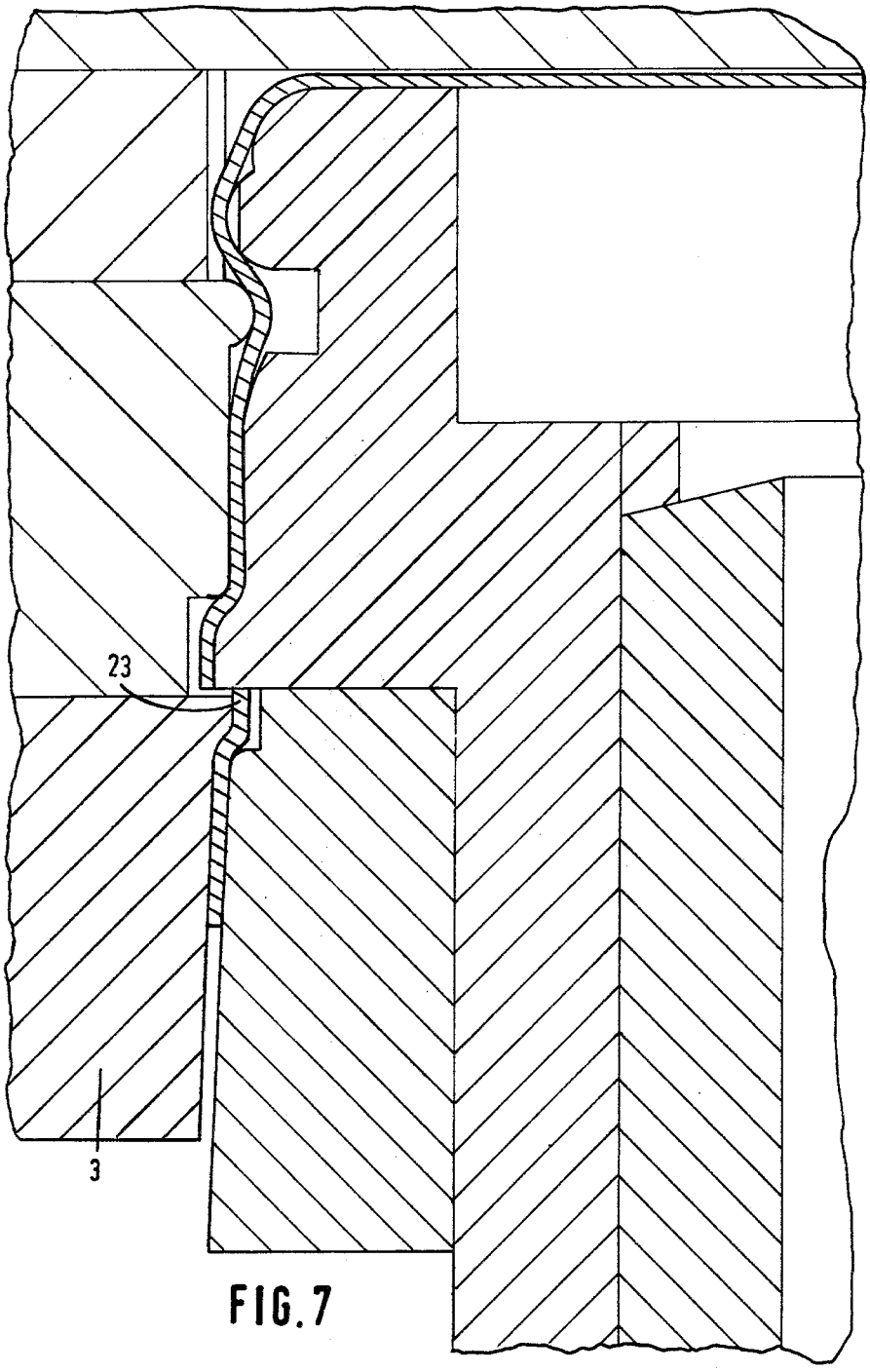
FIG. 7 shows the way in which the slot interrupted by the bridges is formed in the skirt of the capsule. For this purpose segment 3 has a cutting edge 23, whereby the capsule material is completely severed, as clearly shown in the figure.

All knives 5, 6 and 8, 9 are detachably mounted in the segments concerned and can be sharpened. They can be re-adjusted in position owing to their being supported at their bottom side on a threaded pin or bolt. All this is shown diagrammatically in FIG. 1.

Figure 9:
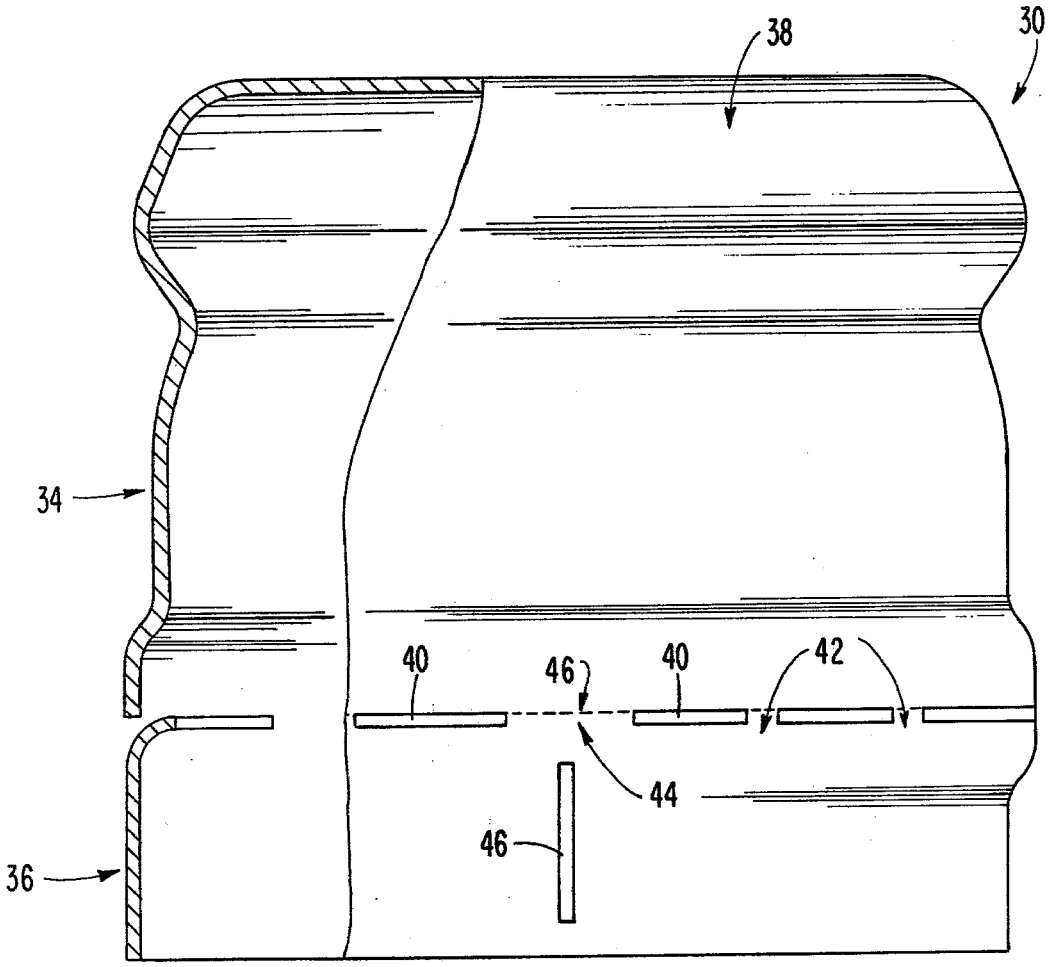

There is shown in FIG. 9 a closure cap 30 having a top portion 32, a skirt 34 depending therefrom and a security band or rim 36 which is detachably connected to the skirt. The top portion of the closure is desirably knurled as shown at 38. A series of circumferentially spaced slots 40 is formed in the cap as described above, the sections between the slots constituting bridges 42 of material. At least one of such bridges 44 is wider than the others. A transverse score line 46 extends upwardly from a point inwardly of the free edge of the security band to a location in the region of the line of slots. At least one of the wider bridges 44 is provided with a weakened line 46 which extends across such bridge in alignment with circumferential slots 40.

The capsules or bottle closures made by the apparatus according to the invention are provided with screw thread in a conventional manner, such screw thread being obtained on the encapsulating machine by deformation of the capsule skirt.

When the contents of a bottle are used for the first time, when the closure cap or capsule is unscrewed, first of all the narrow dams, which have a score line or tear line, will be severed. The lower rim or seal rim will be split up along the transversely extending score line, but remain connected to the skirt through the broad dam. The rim can be removed by being torn off by hand along the score line, so that there is no longer any question of burring and hence injury to the user's hands.

I claim

1. In a tamper-proof bottle closure formed of a readily deformable material threadedly securable on a bottle, said closure including a top portion, a skirt depending from said top portion, a security band detachably connected to said skirt along a circumferential line of spaced slots by bridges of material between the slots, at least one of said bridges being wider circumferentially than the other bridges, and at least one transverse score line formed in the security band and extending upwardly to terminate in the region of the circumferential line of slots, the improvement comprising a weakened line extending circumferentially across at least said one wider bridge and in alignment with the slots on the opposed sides of said wider bridge.

2. A tamper-proof closure according to claim 1 including weakened lines extending across all of the bridges of material connecting said skirt and security band.

3. A tamper-proof closure according to claim 2, wherein the weakened lines provided across said wider bridges are so formed as to more readily enable detachment of the security band from the skirt at such locations.

4. A tamper-proof closure according to claim 2 or 3, wherein said weakened lines extend across the respective bridges so as to form a continuous circumferential line with the upper circumferentially extending extremity of all of said slots.

5. A tamper-proof closure according to claim 1, wherein said transverse score lines terminate at their lower extremities inwardly of the free edge of said security band.

* * * * *